US008303325B2

(12) United States Patent
Yang

(10) Patent No.: US 8,303,325 B2
(45) Date of Patent: Nov. 6, 2012

(54) PLUG-TYPE CONNECTOR

(75) Inventor: Haven Yang, Chung Ho (TW)

(73) Assignee: All Best Precision Technology Co., Ltd., Longtan Township (TW)

( * ) Notice: Subject to any disclaimer, the term of this patent is extended or adjusted under 35 U.S.C. 154(b) by 387 days.

(21) Appl. No.: 12/690,352

(22) Filed: Jan. 20, 2010

(65) Prior Publication Data

US 2011/0177705 A1 Jul. 21, 2011

(51) Int. Cl.
*H01R 13/627* (2006.01)

(52) U.S. Cl. ..... 439/352; 439/372

(58) Field of Classification Search ..... 439/152, 439/153, 350, 352, 357, 358, 372
See application file for complete search history.

(56) References Cited

U.S. PATENT DOCUMENTS 4,708,413 A * 11/1987 Schroeder ..... 439/358
5,021,002 A * 6/1991 Noschese ..... 439/352
5,564,939 A * 10/1996 Maitani et al. ..... 439/352
5,997,323 A * 12/1999 Youn ..... 439/159
6,592,391 B1 * 7/2003 Wu ..... 439/352

* cited by examiner

*Primary Examiner* — Khiem Nguyen
(74) *Attorney, Agent, or Firm* — Apex Juris, pllc; Tracy M. Heims

(57) ABSTRACT

A plug-type connector includes a connector main body having a forward extended front end to provide a plug portion, and being provided on a top surface with an open-topped recess; a push unit including two corresponding sideward-push plates pivotally assembled to the connector main body to locate in the recess; and a pinch unit being assembled to the connector main body to bear against an upper side of the push unit. The plug portion and the pinch unit cooperatively enable the connector main body to firmly connect to a corresponding receptacle, and the sideward-push plates of the push unit can be caused to separately push leftward and rightward to raise the pinch unit and thereby allow disconnection of the connector main body from the receptacle. Therefore, the plug-type connector has simplified structure, and can be firmly connected to a receptacle and easily disconnected therefrom.

6 Claims, 12 Drawing Sheets

A-A'

B-B'

PLUG-TYPE CONNECTOR

FIELD OF THE INVENTION

The present invention relates to a plug-type connector, and more particularly to a plug-type connector that has simplified structure and can be firmly connected to a receptacle and easily disconnected therefrom.

BACKGROUND OF THE INVENTION

FIG. 12 shows a general plug-type connector 5 provided with a conventional locating structure to ensure stable and firm plugging of the plug-type connector 5 in a corresponding receptacle 6. As shown, the plug-type connector 5 has a plug portion 51 forward extended from a front end thereof for plugging in an insertion hole 61 correspondingly provided in the receptacle 6 to form an electrical connection between them for signal transmission. A locating member 52 is pivotally assembled to a top of a main body of the plug-type connector 5. The locating member 52 has a rear end formed into a push portion 522 and a front end formed into at least one hook portion 521. A spring 523 is located between the push portion 522 and the main body of the plug-type connector 5. The hook portion 521 can be engaged with a locating recess 62 that is formed on the receptacle 6 at one side of the insertion hole 61, so as to ensure firm connection of the plug-type connector 5 to the receptacle 6 when the plug portion 51 is plugged in the insertion hole 61. When it is desired to disconnect the plug-type connector 5 from the receptacle 6, the push portion 522 of the locating member 52 is downward pushed to thereby raise the hook portion 521 at the front end of the locating member 52. At this point, the hook portion 521 is disengaged from the locating recess 62 of the receptacle 6, allowing the plug portion 51 to be unplugged from the insertion hole 61.

The above-described conventional plug-type connector 5 has relatively complicated structure. The height by which the hook portion 521 of the locating member 52 can be raised is in direct proportion to the depth by which the push portion 522 at the rear end can be pushed. Being limited by the requirement for miniaturized product, the push portion 522 of the locating member 52 could not be located at an increased height from the top of the main body of the plug-type connector 5, and the locating member 52 must have a thickness as small as possible. Therefore, the locating member 52 often has insufficient strength and tends to deform, and the hook portion 521 could not be exactly raised to a height corresponding to the downward pressed push portion 522. That is, the hook portion 521 might not be fully disengaged from the locating recess 62. On the other hand, the locating member 52 and the spring 523 are subject to deformation when a user applies an excessive force to the push portion 522, preventing the hook portion 521 from effectively engaging with the locating recess 62. Under this condition, the plug-type connector 5 could not be stably and firmly connected to the receptacle 6 when the plug portion 51 is plugged in the insertion hole 61.

It is therefore desirable and tried by the inventor to develop an improved plug-type connector that has simple structure and can be firmly connected to and easily disconnected from a receptacle.

SUMMARY OF THE INVENTION

A primary object of the present invention is to provide a plug-type connector that has simple structure and can be firmly connected to a receptacle via a plug portion and a pinch unit, and be easily disconnected from the receptacle by raising the pinch unit with two sideward-push plates.

To achieve the above and other objects, the plug-type connector according to the present invention includes a connector main body having a forward extended front end to provide a plug portion, and being provided on a top surface with an open-topped recess; a push unit including two corresponding sideward-push plates movably assembled to the connector main body to locate in the recess; and a pinch unit being assembled to the connector main body to bear against an upper side of the push unit.

The plug portion and the pinch unit cooperatively enable the connector main body to firmly connect to a corresponding receptacle, and the sideward-push plates of the push unit can be caused to separately push leftward and rightward to raise the pinch unit and thereby allow disconnection of the connector main body from the receptacle. Therefore, the plug-type connector of the present invention has simplified structure, and can be firmly connected to a receptacle and easily disconnected therefrom.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
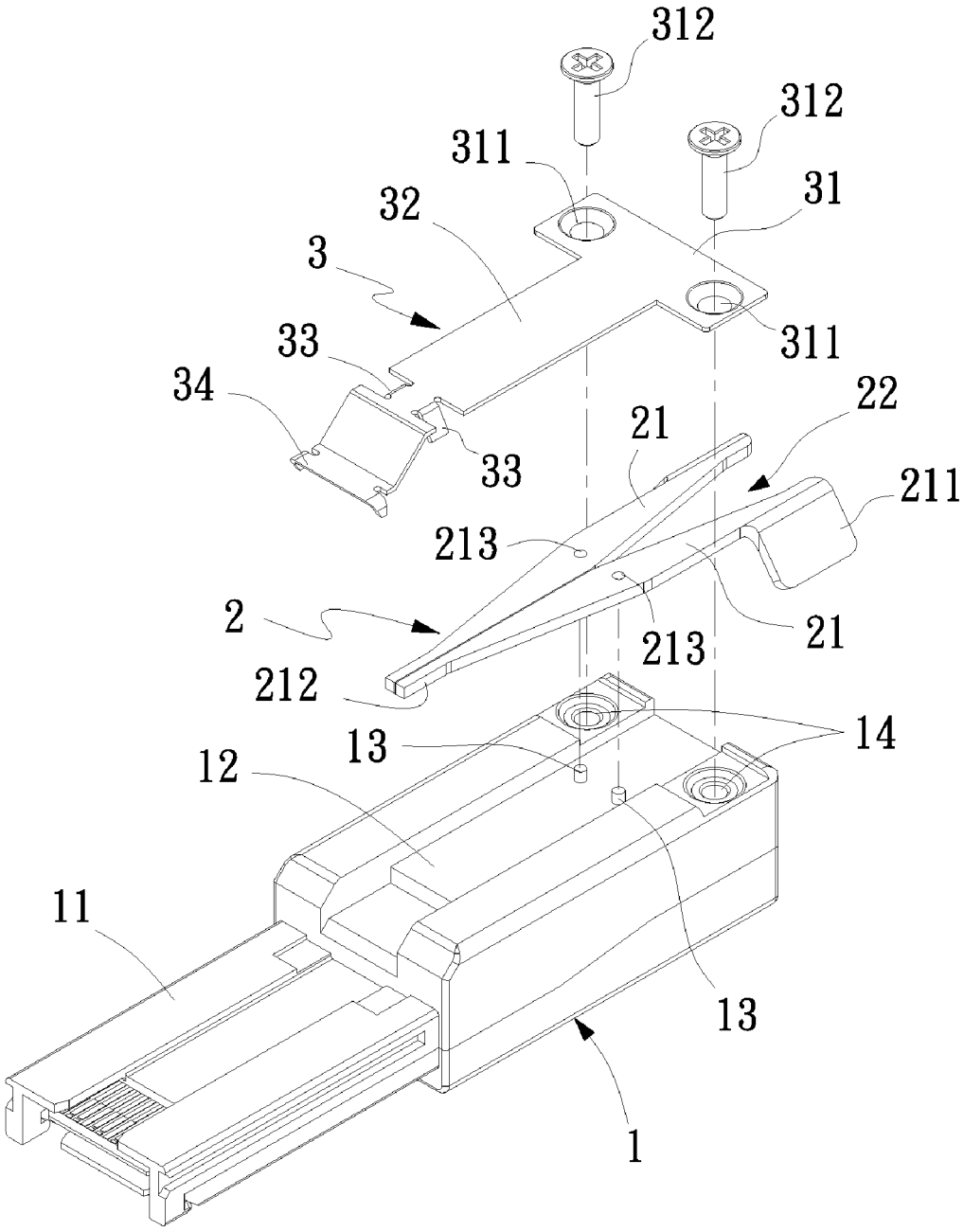
FIG. 1 is an exploded perspective view of a plug-type connector according to a first embodiment of the present invention.

The present invention will now be described with some preferred embodiments thereof. For the purpose of easy to understand, elements that are the same in the preferred embodiments are denoted by the same reference numerals.

Figure 2:
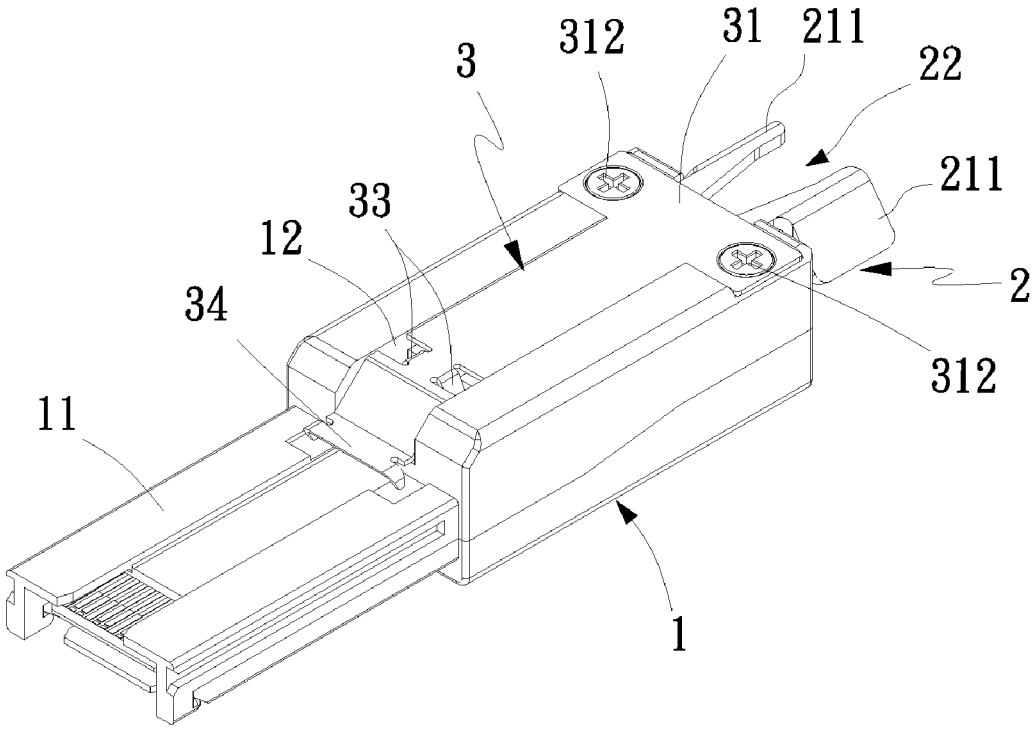
FIG. 2 is an assembled view of FIG. 1.

Please refer to FIGS. 1 and 2 that are exploded and assembled perspective views, respectively, of a plug-type connector according to a first embodiment of the present invention. As shown, the plug-type connector of the first embodiment includes a connector main body 1, a push unit 2, and a pinch unit 3.

The connector main body 1 has a front end that forward extends to provide a plug portion 11. An open-topped recess 12 is formed on a top surface of the connector main body 1 with at least two bosses 13 provided on a bottom of the recess 12. The connector main body 1 is also provided on the top surface outside the recess 12 with two fixing holes 14, which are separately located near two lateral sides of the recess 12.

The push unit 2 is assembled to the connector main body 1, and includes two corresponding sideward-push plates 21. Each of the sideward-push plates 21 has a rear end formed into a push portion 211 rearward extended beyond a rear end of the connector main body 1, and a front end formed into an extension portion 212. And, the sideward-push plates 21 are respectively provided near a middle point with a through hole 213 for pivotally engaging with the bosses 13 in the recess 12. The sideward-push plates 21 are so configured that an opening 22 is formed at the rear end of the push unit 2 between two facing edges of the two push portions 211.

The pinch unit 3 is assembled to the connector main body 1 to bear against an upper side of the sideward-push plates 21 of the push unit 2. The pinch unit 3 includes a fixing plate 31 assembled to the top surface of the connector main body 1, a forward extended elastic leaf spring portion 32 having a rear end connected to a front edge of the fixing plate 31 and sized for setting in the recess 12, two bent tabs 33 downward extended from two opposite lateral edges of the elastic edge leaf spring 32 to separately press against the extension portions 212 of the two sideward-push plates 21, and a pinch plate 34 connected to and forward extended from a front end of the elastic leaf spring portion 32 to locate above the plug portion 11. The fixing plate 31 is provided with two mounting holes 311 corresponding to the two fixing holes 14 on the connector main body 1, so that the whole pinch unit 3 can be assembled to the top surface of the connector main body 1 by extending fastening elements 312 through the mounting holes 311 into the fixing holes 14.

Figure 3:
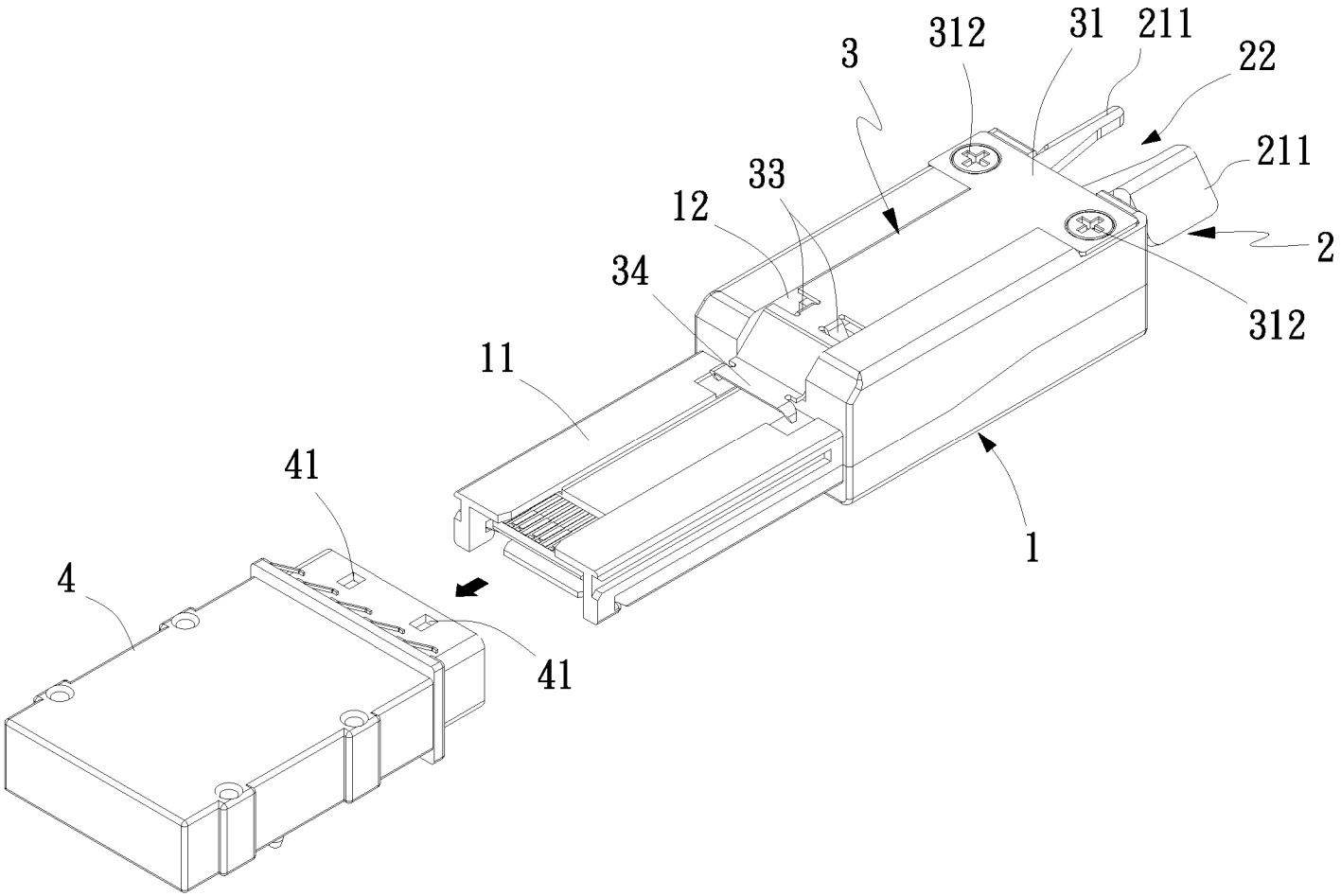
FIG. 3 shows the plug-type connector of FIG. 2 before being plugged in a receptacle for use.
Figure 4:
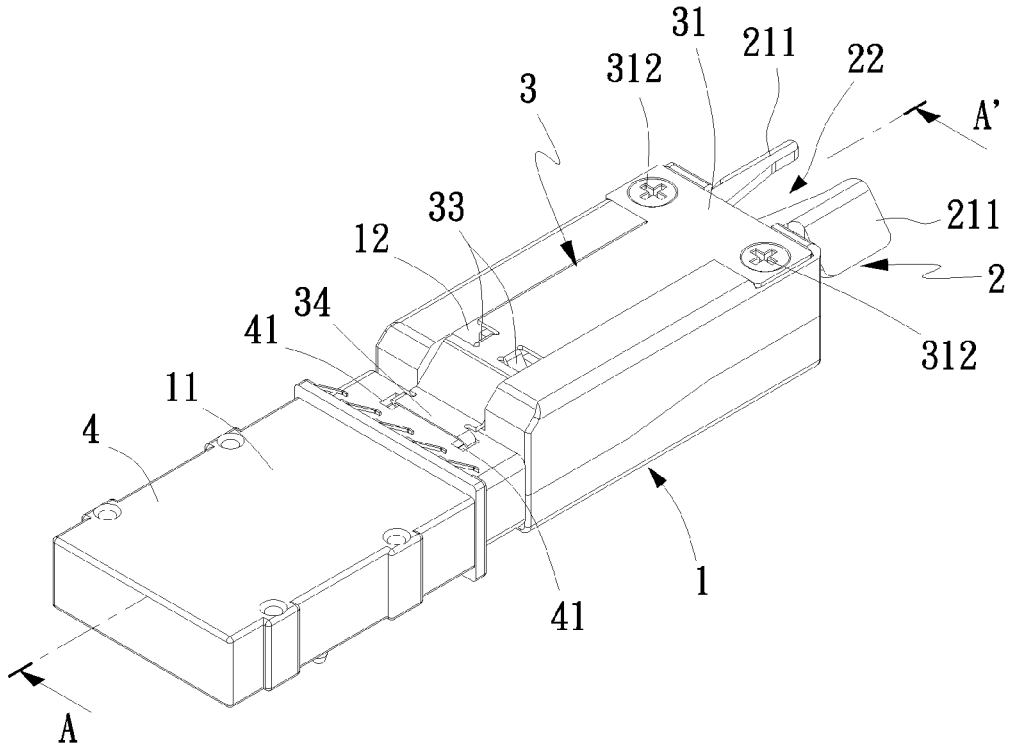
FIG. 4 shows the plug-type connector of FIG. 2 having been plugged in the receptacle.
Figure 5:
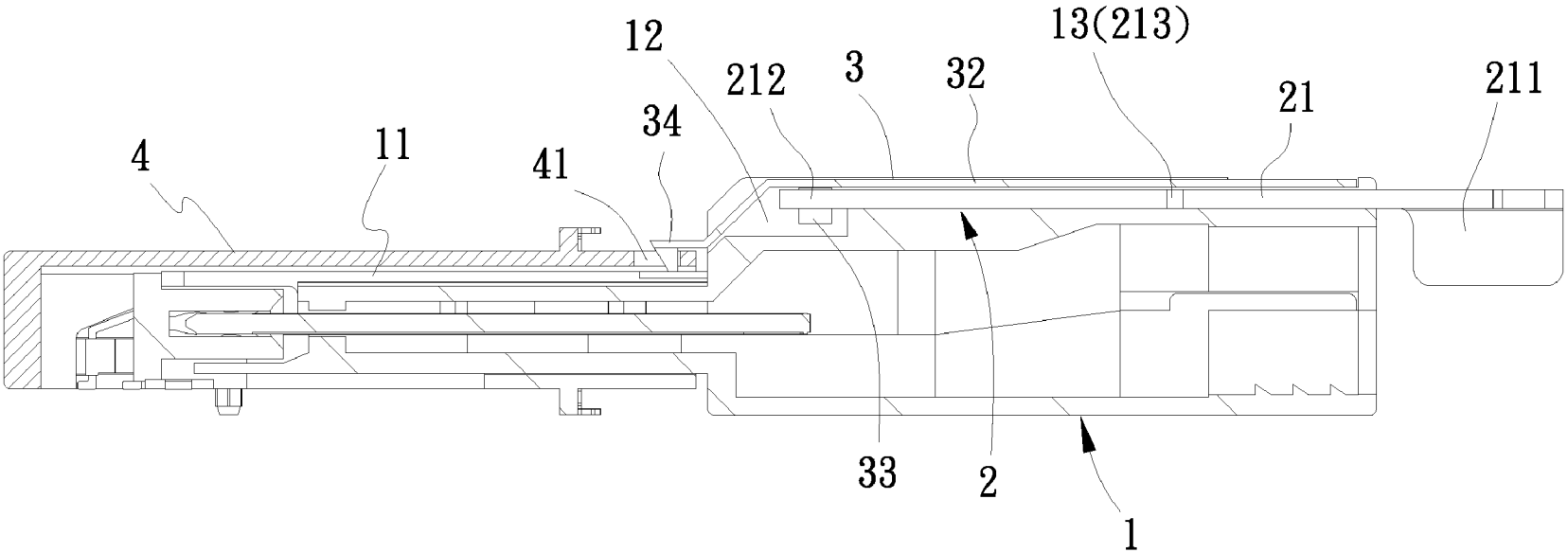
FIG. 5 is a sectional view taken along line A-A' of FIG. 4.
Figure 6:
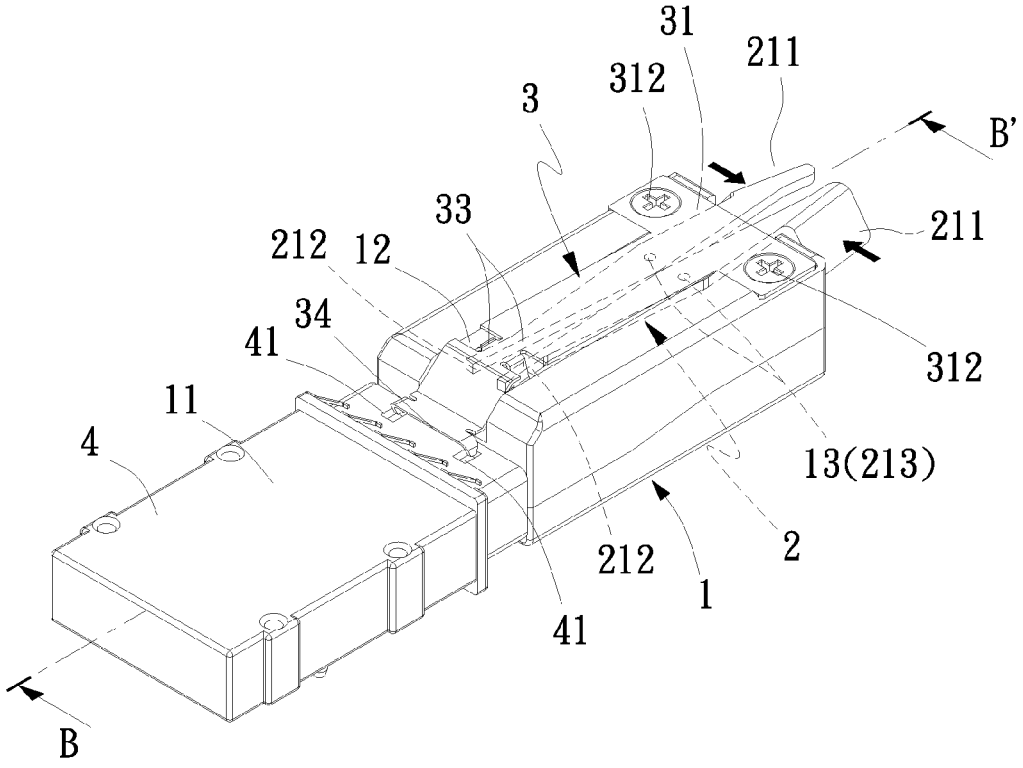
FIG. 6 shows the manner of unplugging the plug-type connector of FIG. 4 from the receptacle.
Figure 7:
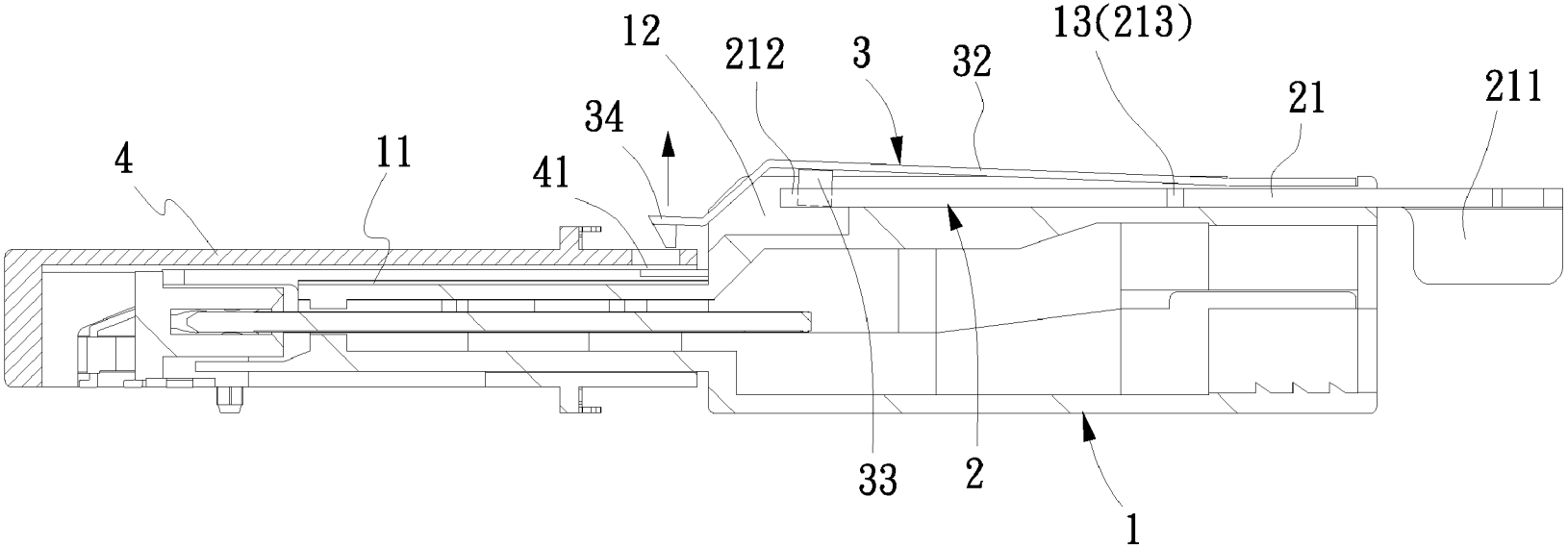
FIG. 7 is a sectional view taken along line B-B' of FIG. 6.

FIGS. 3 and 4 are exploded and assembled perspective views, respectively, showing the plugging of the plug-type connector of the first embodiment in a receptacle for use; FIG. 5 is a sectional view taken along line A-A' of FIG. 4; FIG. 6 shows the manner of unplugging the plug-type connector of the first embodiment from the receptacle; and FIG. 7 is a sectional view taken along line B-B' of FIG. 6. Please refer to FIGS. 3 to 7. To use the plug-type connector, simply plug the plug portion 11 at the front end of the connector main body 1 in a corresponding receptacle 4, and the pinch plate 34 of the pinch unit 3 automatically engages with two receiving holes 41 correspondingly provided on the receptacle 4, so that the connector main body 1 and the receptacle 4 are firmly connected to each other.

When it is desired to disconnect the connector main body 1 from the receptacle 4, simply push the two push portions 211 at the rear end of the sideward-push plates 21 toward the opening 22 at the same time, and the sideward-push plates 21 are brought to pivotally turn about the bosses 13, which are engaged with the through holes 213 at the middle point of the sideward-push plates 21, toward two lateral sides of the recess 12. As a result, the opening 22 is narrowed, and the extension portions 212 at the front end of the sideward-push plates 21 are caused to move leftward and rightward separately to push against the bent tabs 33 at two lateral edges of the pinch unit 3, so that the elastic leaf spring portion 32 is forced to move upward and out of the recess 12 to thereby separate the pinch plate 34 from the receiving holes 41 at the same time, allowing the connector main body 1 to be easily released from the receptacle 4.

Figure 8:
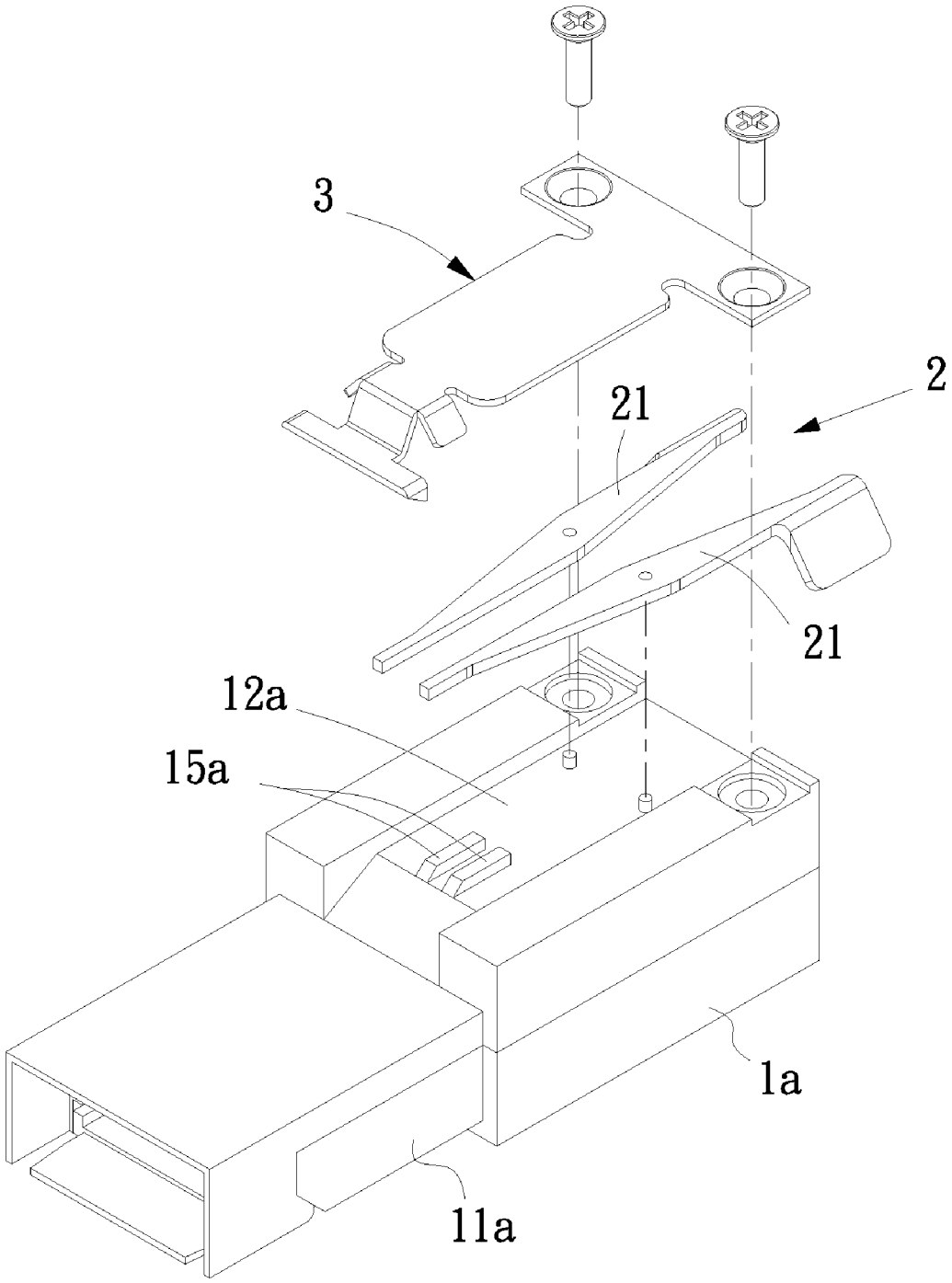
FIG. 8 is an exploded perspective view of a plug-type connector according to a second embodiment of the present invention.
Figure 9:
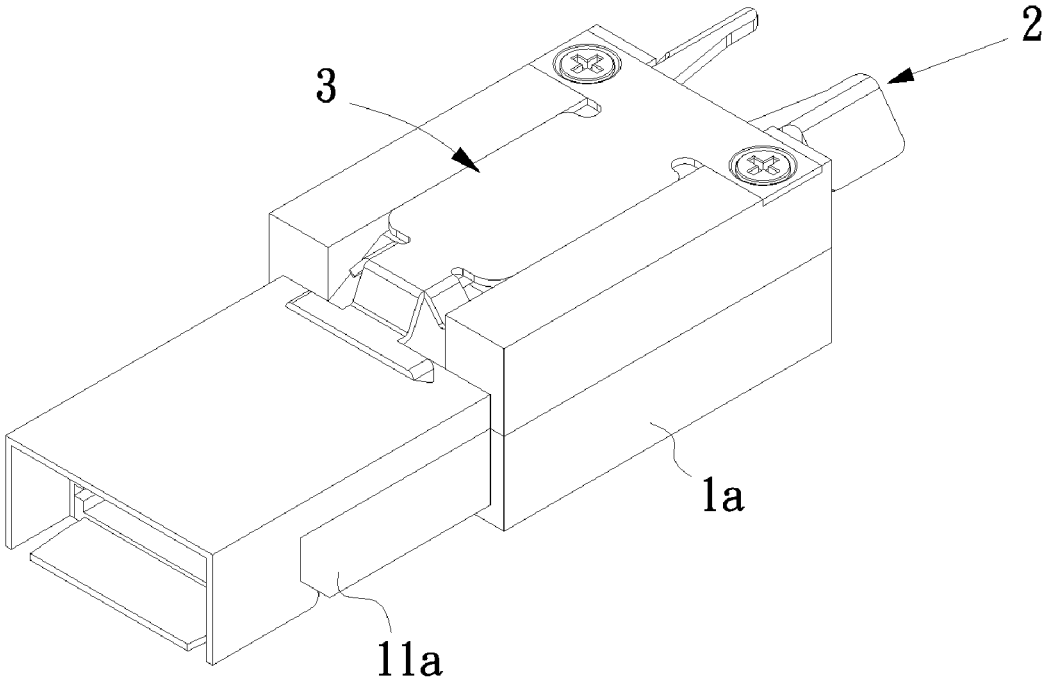
FIG. 9 is an assembled view of FIG. 8.

Please refer to FIGS. 8 and 9 that are exploded and assembled perspective views, respectively, of a plug-type connector according to a second embodiment of the present invention. As shown, the second embodiment is generally structurally similar to the first embodiment, except for a size-increased connector main body 1*a*. The connector main body 1*a* has a forward extended plug portion 11*a* and an open-topped recess 12*a*, and one or more partitioning plates 15*a* are provided in the recess 12*a* at a position near the plug portion 11*a*. In the illustrated second embodiment, two partitioning plates 15*a* are shown. However, it is also acceptable if only one partitioning plate 15*a* is provided. When the push unit 2 is assembled to the connector main body 1*a*, each of the sideward-push plates 21 is restricted to a space defined between one partitioning plate 15*a* and an adjacent lateral side of the recess 12*a*. In this manner, the connector main body 1*a* together with the push unit 2 and the pinch unit 3 can still cooperatively achieve the same function as the first embodiment.

Figure 10:
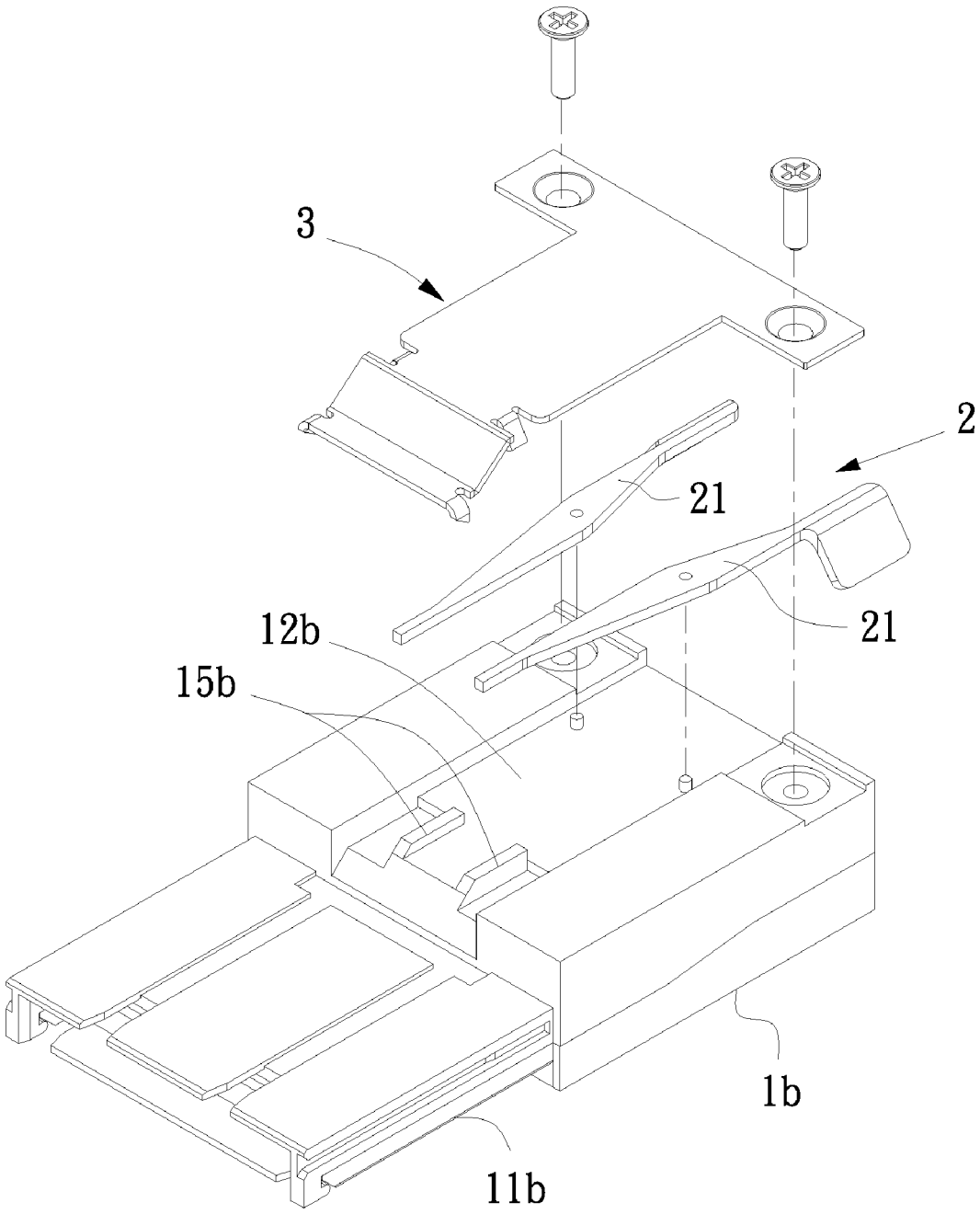
FIG. 10 is an exploded perspective view of a plug-type connector according to a third embodiment of the present invention.
Figure 11:
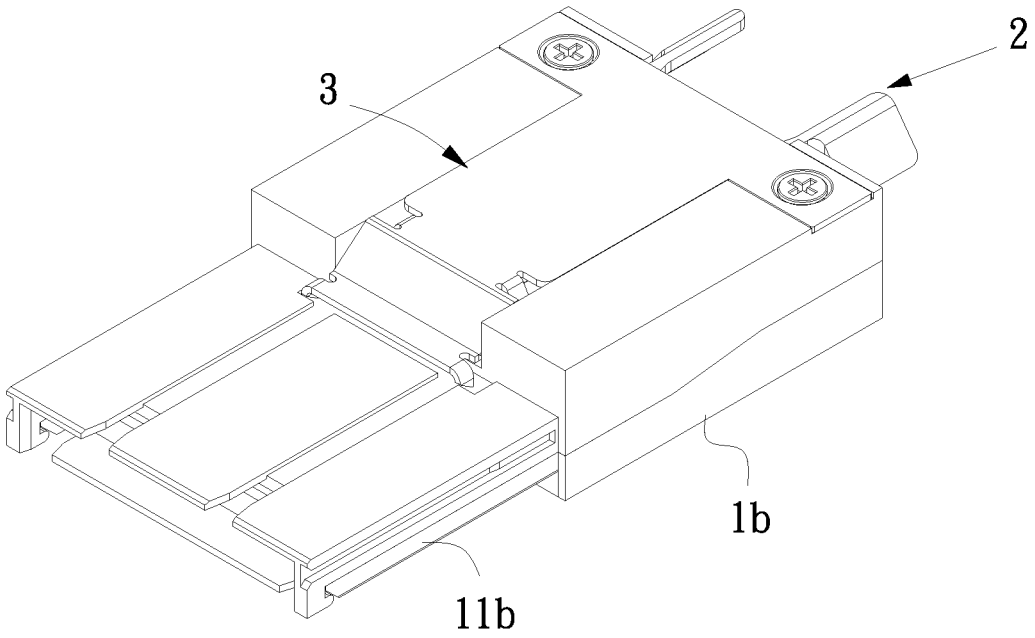
FIG. 11 is an assembled view of FIG. 10.
Figure 12:
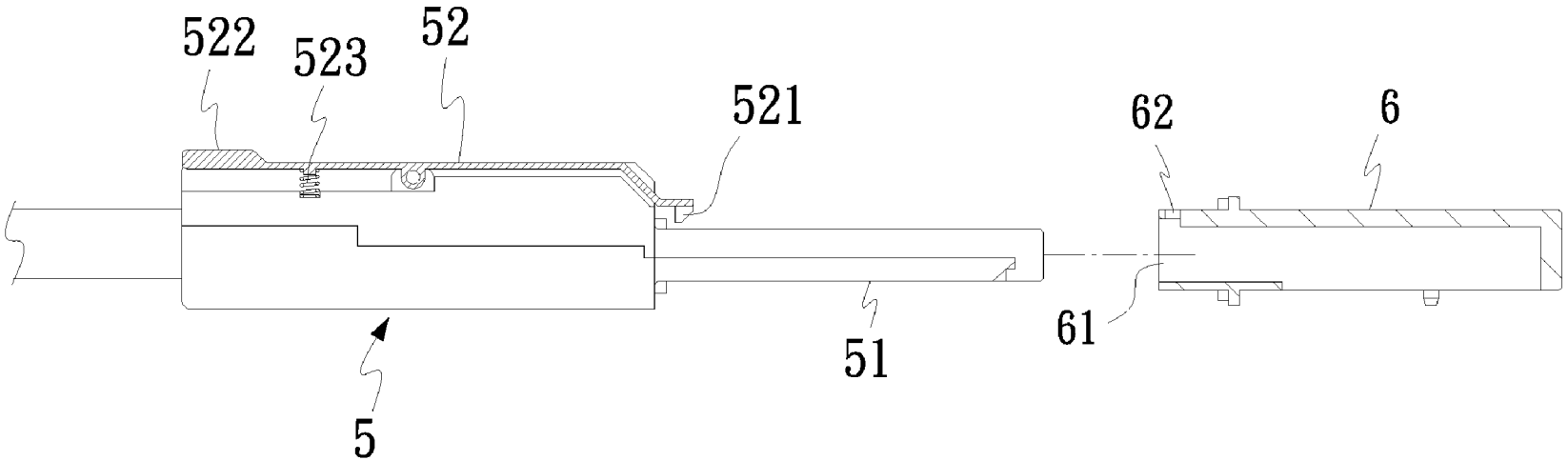
(PRIOR ART) Fig. 12
FIG. 12 is a sectioned side view of a conventional plug-type connector.

Please refer to FIGS. 10 and 11 that are exploded and assembled perspective views, respectively, of a plug-type connector according to a third embodiment of the present invention. As shown, the third embodiment is generally structurally similar to the first and the second embodiment, except for a connector main body 1*b* that has a size being further increased according to actual need to become larger than the connector main body 1*a* in the second embodiment. The connector main body 1*b* has a forward extended plug portion 11*b* and an open-topped recess 12*b*, and one or more partitioning plates 15*b* are provided in the recess 12*b* at a position near the plug portion 11*b*. In the illustrated third embodiment, two partitioning plates 15*b* are shown. However, it is also acceptable if only one partitioning plate 15*b* is provided. When the push unit 2 is assembled to the connector main body 1*b*, each of the sideward-push plates 21 is restricted to a space defined between one partitioning plate 15*b* and an adjacent lateral side of the recess 12*b*. In this manner, the connector main body 1*b* together with the push unit 2 and the pinch unit 3 can still cooperatively achieve the same function as the first embodiment.

In the plug-type connector of the present invention, the plug portion and the pinch unit cooperatively enable the connector main body to firmly connect to a corresponding receptacle, and the sideward-push plates of the push unit can be caused to separately push leftward and rightward to raise the pinch unit and thereby allow disconnection of the connector main body from the receptacle. With these arrangements, the plug-type connector has simplified structure, and can be firmly connected to a receptacle and easily disconnected therefrom. These advantages make the present invention novel and improved. Meanwhile, the present invention is industrially practical for use because products derived from the present invention would no doubt satisfy the market demands.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A plug-type connector, comprising:

a connector main body having a forward extended front end to provide a plug portion, and being provided on a top surface with an open-topped recess;

a push unit including two corresponding sideward-push plates pivotally assembled to the connector main body to locate in the recess; and a pinch unit being assembled to the connector main body to bear against an upper side of the push unit, wherein the pinch unit is bearing against an upper side of the sideward-push plates, and includes a fixing plate assembled to the top surface of the connector main body, a forward extended elastic leaf spring portion having a rear end connected to a front edge of the fixing plate and sized for setting in the recess, two bent tabs downward extended from two opposite lateral edges of the elastic leaf spring portion to separately press against a front end of the two sideward-push plates, and a pinch plate connected to and forward extended from a front end of the elastic leaf spring portion to locate above the plug portion.

2. The plug-type connector as claimed in claim 1, wherein the connector main body is provided on the top surface with two fixing holes, which are separately located near two lateral sides of the recess; and the pinch unit being connected at a rear end to the fixing holes via fastening elements.

3. The plug-type connector as claimed in claim 1, wherein the recess has at least two bosses provided therein, and the two sideward-push plates being respectively provided with a through hole for pivotally engaging with the bosses.

4. The plug-type connector as claimed in claim 1, wherein the recess has one or more partitioning plates provided therein, and the partitioning plates being located at a position near the plug portion, so that each of the sideward-push plates is restricted to a space defined between one partitioning plate and an adjacent lateral side of the recess.

5. The plug-type connector as claimed in claim 1, wherein each of the two sideward-push plates has a rear end formed into a push portion, which is rearward extended beyond a rear end of the connector main body, and a front end formed into an extension portion for pushing against the pinch unit; and the sideward-push plates being so configured that an opening is formed at the rear end of the push unit between two facing edges of the two push portions.

6. The plug-type connector as claimed in claim 1, wherein the fixing plate is provided with at least two mounting holes, and the fixing plate being assembled to the connector main body by extending fastening elements through the mounting holes into the connector main body.

* * * * *